US005103710A

United States Patent [19]

Ross

[11] Patent Number: 5,103,710

[45] Date of Patent: Apr. 14, 1992

[54] MEDIA HANDLING AND CUTTING DEVICE

[76] Inventor: Scott S. Ross, 405 Ransom Rd., Walla Walla, Wash. 99362

[21] Appl. No.: 674,065

[22] Filed: Mar. 19, 1991

[51] Int. Cl.[5] ..... B26D 7/26

[52] U.S. Cl. ..... 83/485; 83/522.11; 83/614; 83/649; 83/485

[58] Field of Search ..... 83/614, 455, 485, 649, 83/650, 44, 408, 522.15, 522.16, 522.17, 522.18, 522.19, 522.11

[56] References Cited

U.S. PATENT DOCUMENTS

| | | | |
|---|---|---|---|
| 3,788,175 | 1/1974 | Davis | 83/614 |
| 3,821,915 | 7/1974 | Larrable | 83/649 |

FOREIGN PATENT DOCUMENTS

| | | | |
|---|---|---|---|
| 0490561 | 2/1953 | Canada | 83/485 |
| 2758563 | 7/1979 | Fed. Rep. of Germany | 83/455 |
| 2064475 | 6/1981 | United Kingdom | 83/650 |

*Primary Examiner*—Douglas D. Watts
*Assistant Examiner*—Allan M. Schrock

[57] ABSTRACT

A device for handling and performing operations upon media, the media having been previously wound about a retaining device such as a cylinder. The rolled media, such as paper, plastic film, and fabric, is removably secured to support members on the device in a manner that allows media to be unrolled and placed upon a working surface such as a table. Rollers and a u-shaped member guide the media to and hold the media upon the working surface such that the media may be measured, marked, and cut to the desired length and/or width, as deemed necessary by the user. Both the length and width of cut is readily adjustable. The media may be cut to a desired width by adjusting the location of the cutter, engaging the cutter, and pulling the media through the device. The media may be cut to length by pulling the media through the device, stopping when the desired length is reached, engaging the cutter and sliding the cutter across the width of the media. Ruled markings, strategically placed upon components of the device may be used to measure and mark media widths and/or lengths as desired.

2 Claims, 10 Drawing Sheets

MEDIA HANDLING AND CUTTING DEVICE

BACKGROUND OF THE INVENTION

1. Field of the Invention

This invention relates in general to handling and cutting media, such as paper, plastic film, and fabric, that is to be marked and/or cut to size as it is removed from the "roll". The invention provides a convenient means of handling, marking, and cutting media, especially media used for wrapping objects and media from which a preprinted square or rectangular shape is to be cut.

2. Description of the Prior Art

Media in "roll" form, although being a convenient means of neatly storing media within a limited space, is awkward to handle and dispense. Typically, rolled media is placed upon a relatively flat surface and manually unrolled to the length desired. If the working surface is not truly level, the roll of media tends to move, due to gravity, in the direction of the down-hill slope of the working surface. To prevent this from happening, the working surface must be level or some auxiliary means of stopping roll movement (such as a paper weight), must be used. If the working surface is level, the media roll still tends to move as paper is pulled off the roll or if the roll is bumped or jarred by the user. In some instances, media that has been on the roll for a period of time develops a "memory" for the shape of the roll on which it was placed. This memory causes the media to curl or roll upon itself as it is removed from the roll. To overcome this problem, additional means of holding the media (such as paper weights) to the working surface are typically used. The paper weights may interfere with the cutting process and repositioning or adding additional weights may be required. Cutting is typically performed using scissors or some form of razor knife. If the desired shape to be cut is not preprinted on the media, the user must by some means measure and mark the media prior to cutting. In most instances, if a reasonably straight and square cut is desired, the user must carefully cut the media along lines placed upon the media. Scissor cut edges, if not cut carefully, may be jagged. Razor cutting may require the use of a cutting board if damage to the working surface is to be avoided. To cut additional media from the roll, the entire procedure is repeated.

SUMMARY OF THE INVENTION

The primary objective of the present invention is to provide a device for handling, dispensing, and cutting media, such as paper, plastic, and fabrics, in an organized and efficient manner. Media that is essentially in bulk form, having been wound about a retaining device such as a cylindrical roll, is placed within the device where it is retained so as to prevent the roll of media from moving about the working surface as media is withdrawn from the roll. As media is withdrawn from the roll, auxiliary means for disposing the media upon the working surface position and hold the media against the working surface, thus eliminating the tendency for the media to curl, roll upon itself, and wrinkle while measuring, marking, and cutting operations are performed upon the media. A cutter secured to the device allows the media to be cut to length and/or width, as desired by the operator.

DESCRIPTION OF THE PREFERRED EMBODIMENT

Figure 1:
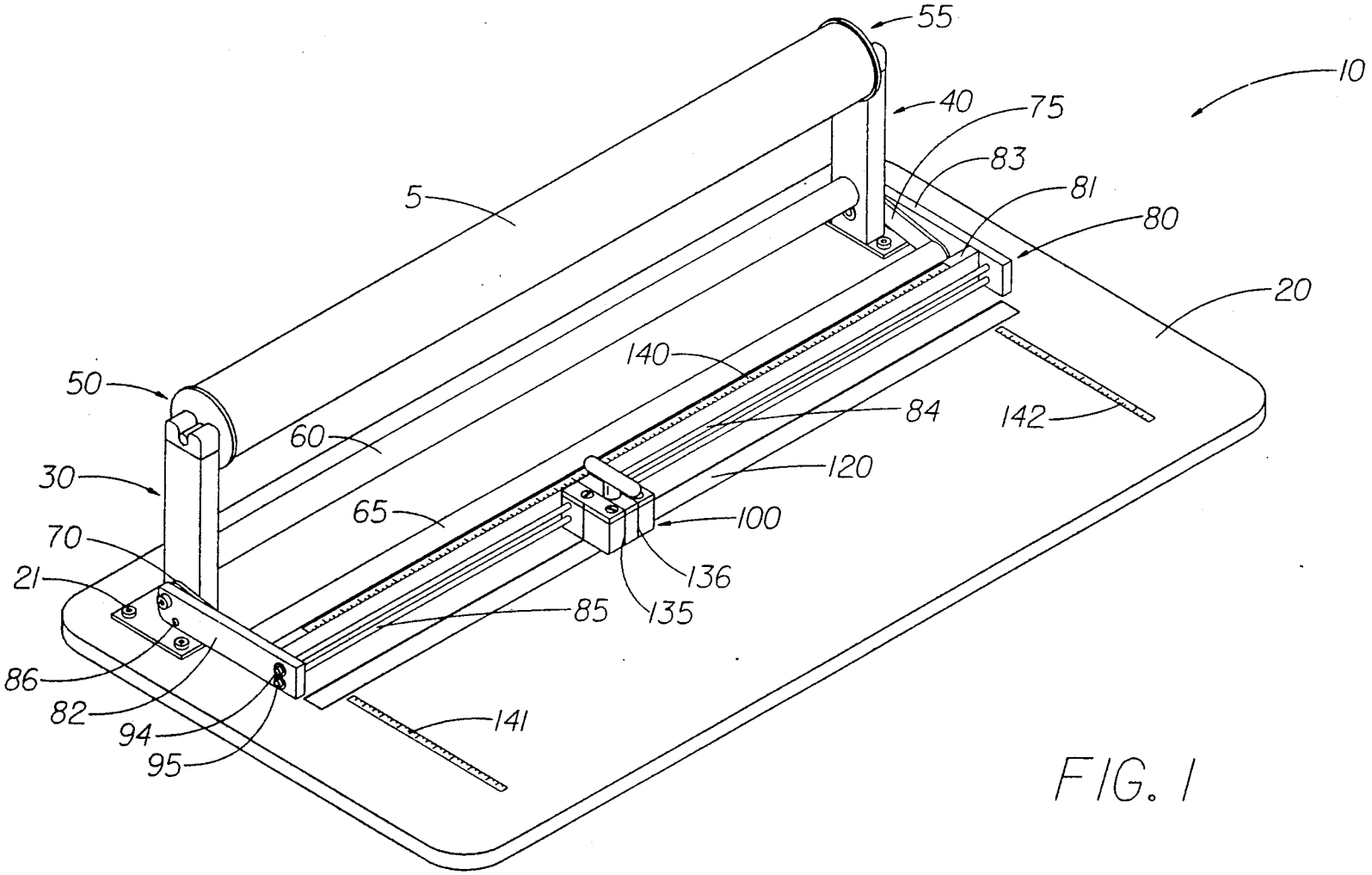
FIG. 1 is a perspective view of a media handling and cutting device according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention, alterations and further modifications in the illustrated device, and further applications of the principles of the invention illustrated, as would normally occur to one skilled in the art to which the invention relates, is thereby intended.

Figure 2:
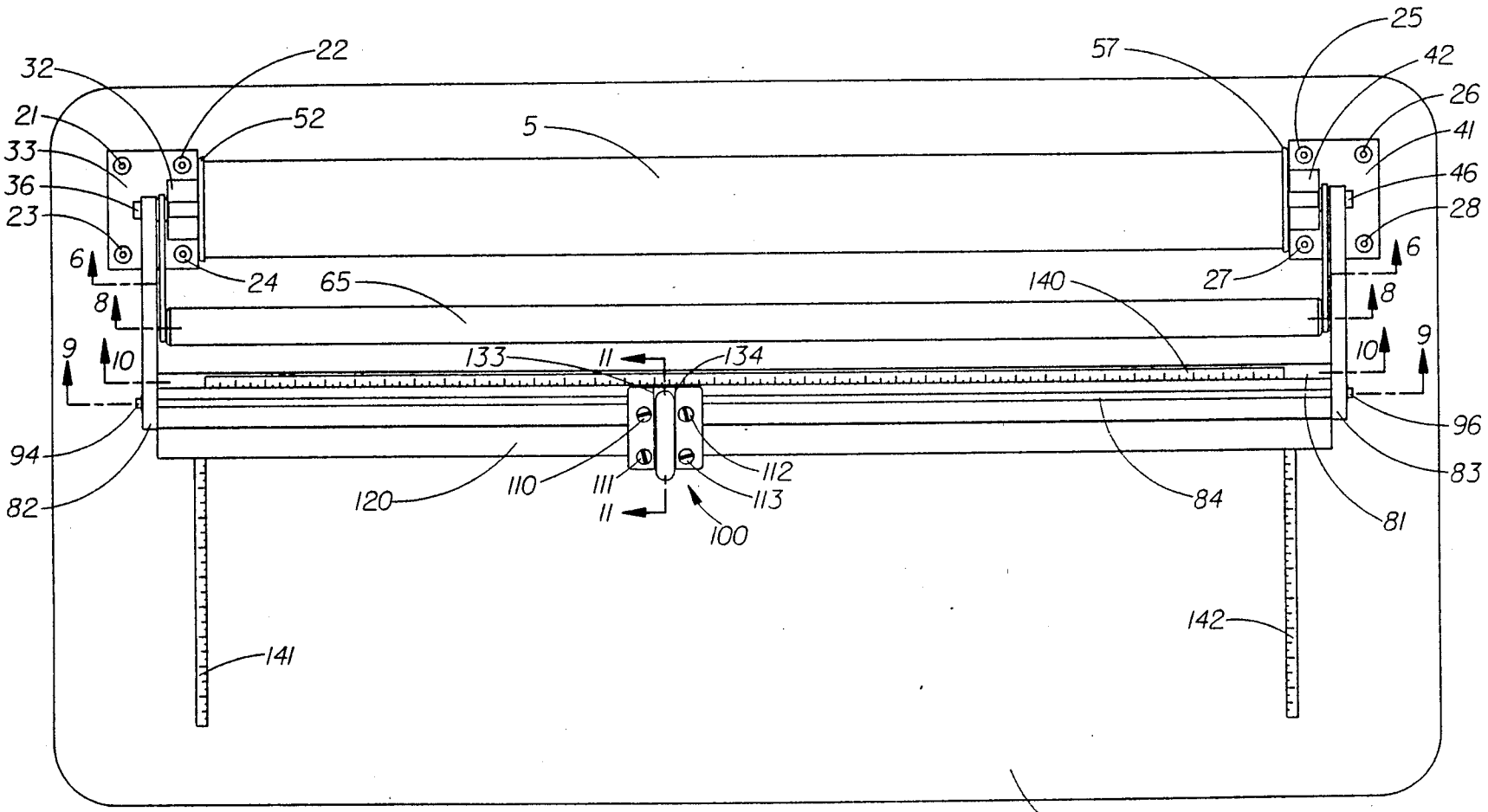
FIG. 2 is a plan view of the FIG. 1 media handling and cutting device.
Figure 3:
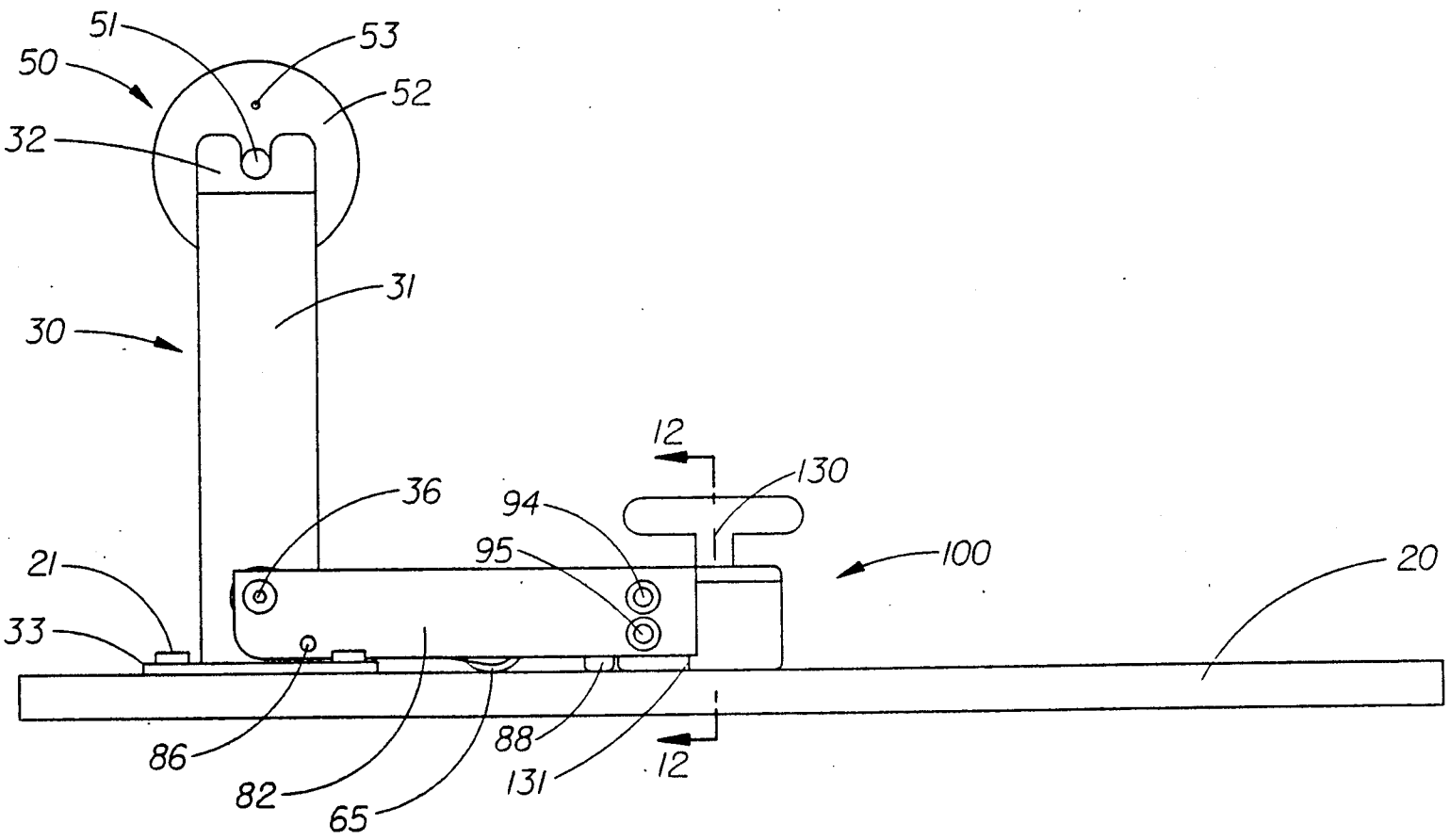
FIG. 3 is a side view of the FIG. 1 media handling and cutting device.
Figure 4:
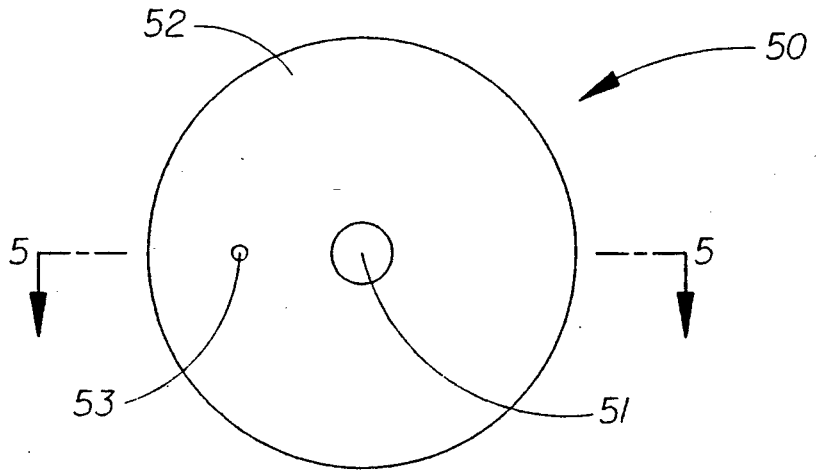
FIG. 4 is a side view of the hubs which comprise a portion of the FIG. 1 media handling and cutting device.
Figure 5:
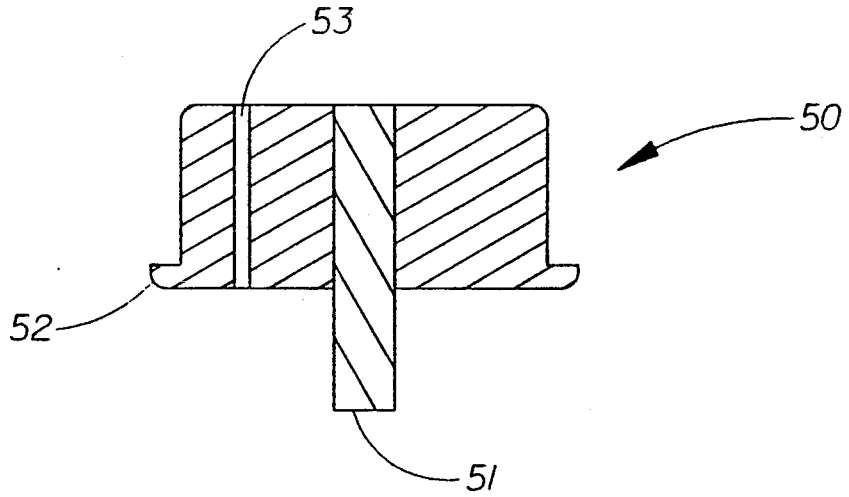
FIG. 5 is a section view of the FIG. 4 hubs taken along line 5—5 in FIG. 4.

Referring to FIG. 1, FIG. 2, and FIG. 3, there is illustrated a roll of media 5 and a media handling and cutting device 10. The media handling and cutting device 10 includes a working surface 20, media support columns 30 and 40, hubs 50 and 55, roller 60, pivotal roller 65, linkage members 70 and 75, u-shaped assembly 80, and cutter head assembly 100. Roll of media 5 includes a cylindrical roll upon which media is wound, the length of the cylindrical roll being equivalent to the width of the media, the ends of the cylindrical roll and the edges of the media being square with the longitudinal axis of the cylindrical roll. Hubs 50 and 55 include hub shafts 51 and 56 and flanged ends 52 and 57 (see FIG. 4 and FIG. 5). The cylindrical outer surfaces of hubs 50 and 55 are suitably sized to allow insertion within the ends of and to provide a snug fit within roll of media 5. Flanged ends 52 and 57 contact the ends of roll of media 5 to maintain alignment of and prevent overinsertion of hubs 50 and 55 within roll of media 5. Hub shafts 51 and 56 are joined to hubs 50 and 55, such that the longitudinal centerlines of hub shafts 51 and 56 are substantially coincident with the longitudinal centerlines of hubs 50 and 55, by a suitable joining method such as, for example, a press fit between the outer surfaces of hub shafts 51 and 5 and holes drilled through hubs 50 and 55. Hub shafts 51 and 56 extend outward beyond flanged ends 52 and 57 for mounting upon media support columns 30 and 40. Air holes 53 and 58 allow the passage of air as hubs 50 and 55 are inserted or removed from roll of media 5. The dimensions of hubs 50 and 55 are substantially equivalent such that they may be used interchangeably on either end of roll of media 5. When inserted within roll of media 5, the longitudinal centerlines of hubs 50 and 55 are coincident with the longitudinal centerline of roll of media 5.

Figure 6:
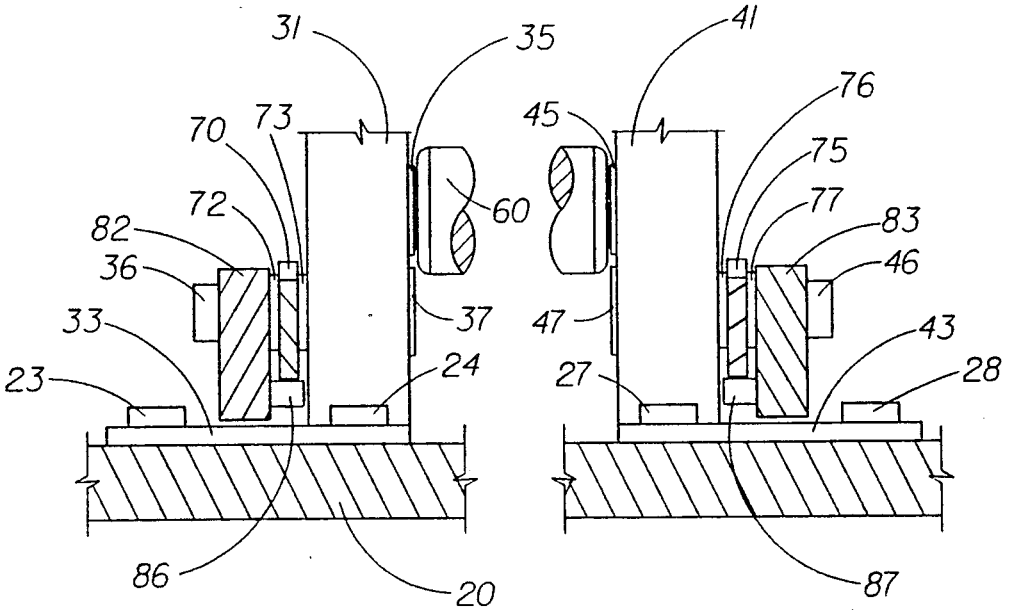
FIG. 6 is a section view of the FIG. 1 media handling and cutting device taken along line 6—6 in FIG. 2.
Figure 7:
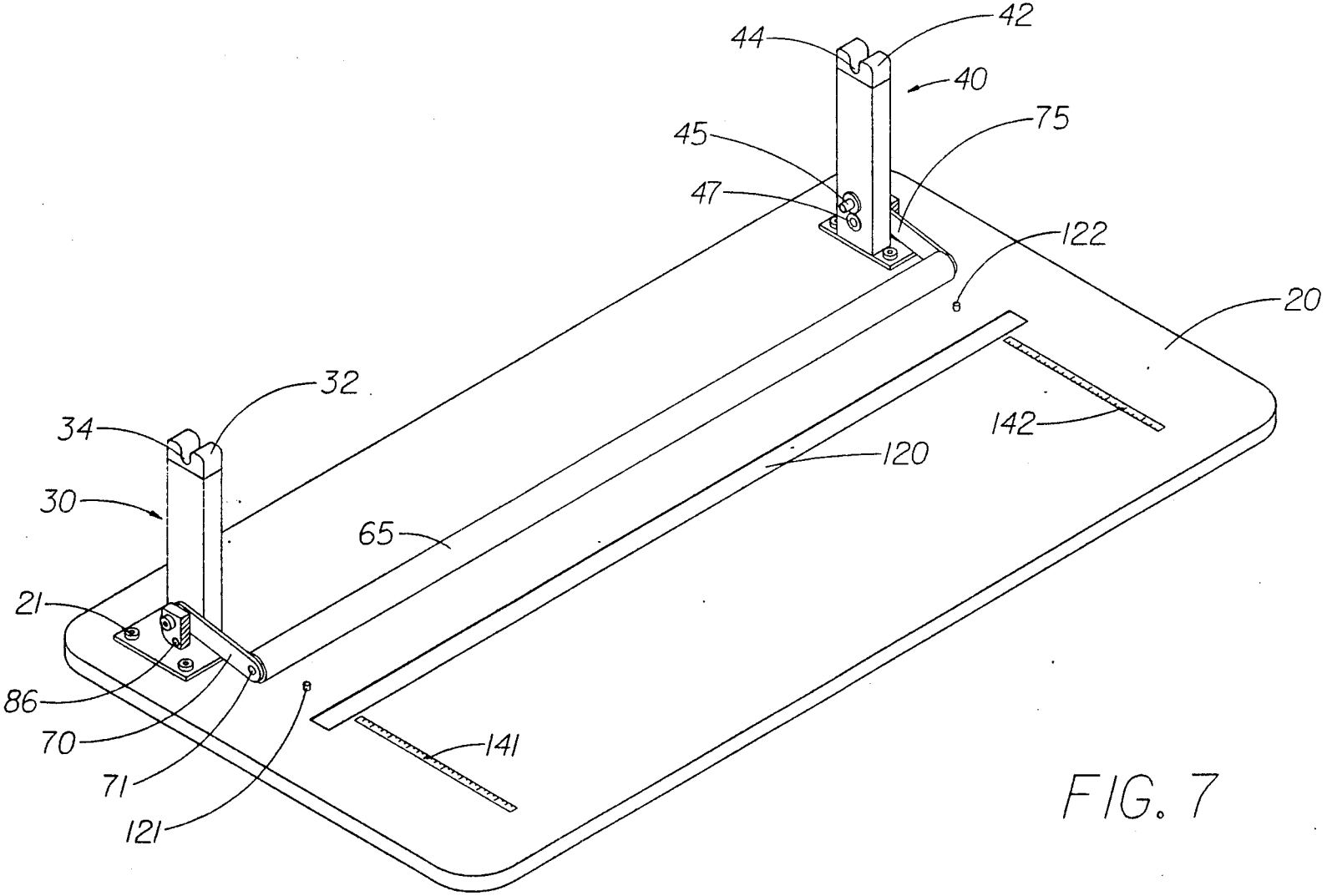
FIG. 7 is a partial perspective view of the FIG. 1 media handling and cutting device without fully illustrating the u-shaped assembly and without illustrating the roll of media, hubs, roller, and the cutter head such that the remaining components may be better illustrated.
Figure 9:
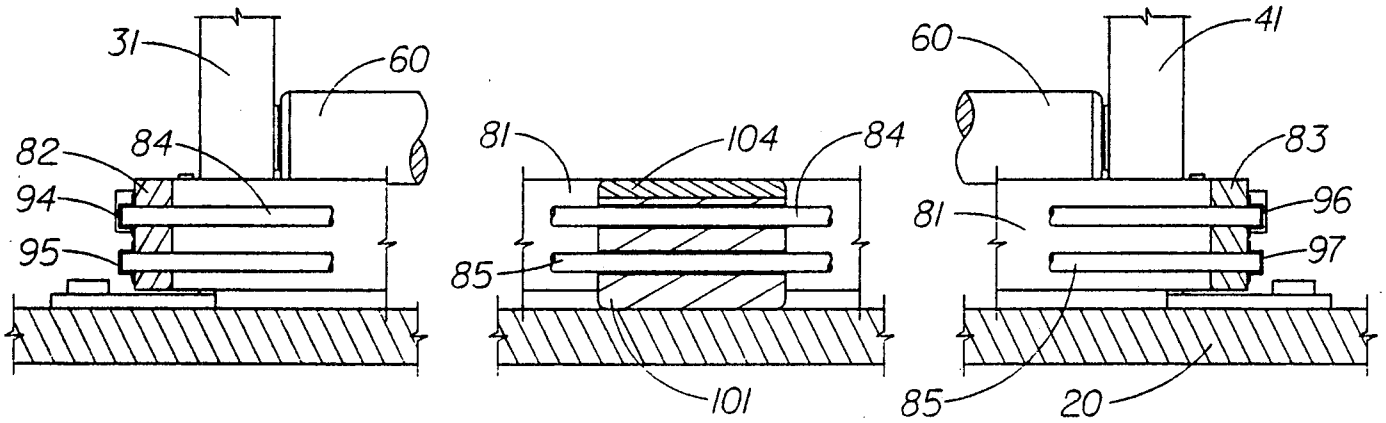
FIG. 9 is a section view of the FIG. 1 media handling and cutting device taken along line 9—9 on FIG. 2.

Media support columns 30 and 40 include hollow support members 31 and 41, hub shaft saddles 32 and 42, and mounting bases 33 and 43 (see FIG. 6 and FIG. 7). Mounting bases 33 and 43 are attached to the bottom edges of support members 31 and 41 by a suitable metal to metal joining method such as, for example, welding. Hub shaft saddles 32 and 42 are attached to the top ends of support members 31 and 41 by a suitable joining method such as, for example, a press fit between recessed outer surfaces of hub shaft saddles 32 and 42 and the inner surfaces of support members 31 and 41. Curved recesses 34 and 44, extending through hub shaft saddles 32 and 42 at a location coincident with the centerlines of the media support columns 30 and 40 and hub shaft saddles 32 and 42, accept and locate hub shafts 51 and 56. Hub shaft saddles 32 and 42 are made of a suitable material such as, for example, plastic, with a smooth surface finish along curved recesses 34 and 44 so as to provide low-friction contact areas upon which hub shafts 51 and 56 may be rotated. The perpendicular lengths between the bottom surfaces of mounting bases 33 and 43 and the centerline of curved recesses 34 and 44 are equal such that roll of media 5 is elevated by media support columns 30 and 40 parallel to the top of working surface 20. The centerlines of curved surfaces 34 and 44 are parallel to the bottom surfaces of mounting bases 33 and 43 and perpendicular to the longitudinal centerlines of support members 31 and 41. Media support columns 30 and 40 are attached to working surface 20 using, for example, threaded fasteners 21, 22, 23, 24, 25, 26, 27, and 28, at a spacing slightly greater than the combined assembled length of roll of media 5 and flanged ends 52 and 57. The centerlines of curved recesses 34 and 44 are paralleled to the centerline of roll of media 5. The spacing for mounting media support columns 30 and 40 to working surface 20 is sufficient to provide minimal clearance necessary for installation and removal of the assembly of roll of media 5 and hubs 50 and 55.

Roller 60 is a rigid cylindrical rod connected to support members 31 and 41 such that roller 60 is free to rotate about its longitudinal centerline, the longitudinal centerline of roller 60 being parallel, in both horizontal and vertical planes, to the longitudinal centerline of roll of media 5. Roller 60 is attached to support members 31 and 41 at an elevation sufficiently above the working surface to allow the passage of media between roller 60 and the top of working surface 20, using, for example, weld-nuts 35 and 45 welded to support members 31 and 41 such that the barrels of weld nuts 35 and 45 extend into holes bored into the ends of roller 60 along the longitudinal centerline of roller 60. The holes bored into the ends of roller 60 are slightly larger and deeper than the barrel diameters and barrel lengths, respectively, of weld nuts 35 and 45. The length of roller 60 is slightly less than the distance between the exposed base surfaces of weld nuts 35 and 45.

Linkage members 70 and 75 and u-shaped assembly 80 are connected to support members 31 and 41 using, for example, shoulder bolts 36 and 46 and weld nuts 37 and 47 (see FIG. 6). The holes drilled through linkage members 70 and 75 and side members 82 and 83 for shoulder bolts 36 and 46 are slightly larger than the shoulder diameter of shoulder bolts 36 and 46 such that both linkage members 70 and 75 and u-shaped assembly 80 can be pivoted about shoulder bolts 36 and 46. The holes drilled through support members 31 and 41 for shoulder bolts 36 and 46 and weld nuts 37 and 47 provide minimal diametrical clearance for shoulder bolts 36 and 46 and weld nuts 37 and 47 such that the assembly of weld nut 37 and shoulder bolt 36 within support member 31 and the assembly of weld nut 47 and shoulder bolt 46 within support member 41 are sufficiently rigid. The longitudinal centerlines of shoulder bolts 36 and 46 are parallel, in both horizontal and vertical planes, to the longitudinal centerline of roll of media 5. Washers 72, 73, 74, 77, 78 and 79 are of suitable thickness and constructed of a material which has a sufficiently low coefficient of friction such that the tightened connections of shoulder bolt 36 and weld nut 37 and shoulder bolt 46 and weld nut 47 are without excessive play and frictional resistance to pivoting of linkage members 70 and 75 and u-shaped assembly 80.

Figure 8:
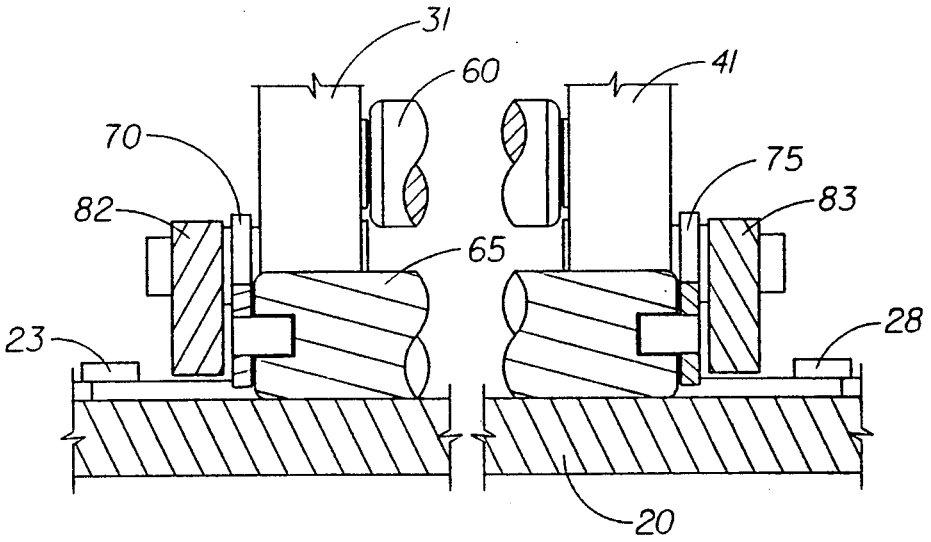
FIG. 8 is a section view of the FIG. 1 media handling and cutting device taken along line 8—8 on FIG. 2.

Pivotal roller 65 is a rigid cylindrical rod connected to linkage members 70 and 75 using dowel pins 71 and 76 such that pivotal roller 65 is free to rotate about its longitudinal centerline (see FIG. 7 and FIG. 8). Dowel pins 71 and 76 are attached to linkage members 70 and 75 using, for example, a press fit between holes bored through linkage members 70 and 75 and the outer surfaces of dowel pins 71 and 76. Dowel pins 71 and 76 are flush with one surface of linkage members 70 and 75 and extend through linkage members 70 and 75 and beyond into holes bored within the ends of pivotal roller 65 along the longitudinal centerline of pivotal roller 65. The holes bored into the ends of pivotal roller 65 are slightly larger and deeper than the diameter and extending length, respectfully, of dowel pins 71 and 76. The length of pivotal roller 65 is slightly less than the distance between the inside edges of linkage members 70 and 75. The thickness and width of linkage members 70 and 75 are sufficient to provide rigidity and to withstand the press fit with dowel pins 71 and 76. The width of linkage members 70 and 75 is less than the diameter of pivotal roller 65. Linkage members 70 and 75 are dimensionally equivalent such that they may be used interchangeably on either end of pivotal roller 65 with the longitudinal centerline of pivotal roller 65 being parallel to the longitudinal centerline of roller 60.

U-shaped assembly 80 includes front member 81, side members 82 and 83, rods 84 and 85, lift pins 86 and 87, and bar 88 (see FIG. 1, FIG. 2, FIG. 3, FIG. 6 and FIG. 9). Side members 82 and 83 are parallel to one another and perpendicular to front member 81. Side members 82 and 83 are of a suitable length to prevent interference between pivotal roller 65 and u-shaped assembly 80 and to allow suitable access to media placed upon working surface 20 beneath u-shaped assembly 80 and pivotal roller 65. Front member 81 is rigidly connected to side members 82 and 83 using a suitable metal to metal joining technique, such as, for example, welding. The perpendicular distances between the centerlines of the holes bored through side members 82 and 83 for shoulder bolts 36 and 46 and the longitudinal centerline of front member 81 are equivalent such that front member 81 is parallel to the longitudinal centerline of roller 60. The holes bored through side members 82 and 83 for shoulder bolts 36 and 46 are located such that a plane passing through the longitudinal centerlines of side members 82 and 83 is parallel to the top of working surface 20 when u-shaped assembly 80 is fully lowered against working surface 20.

Figure 10:
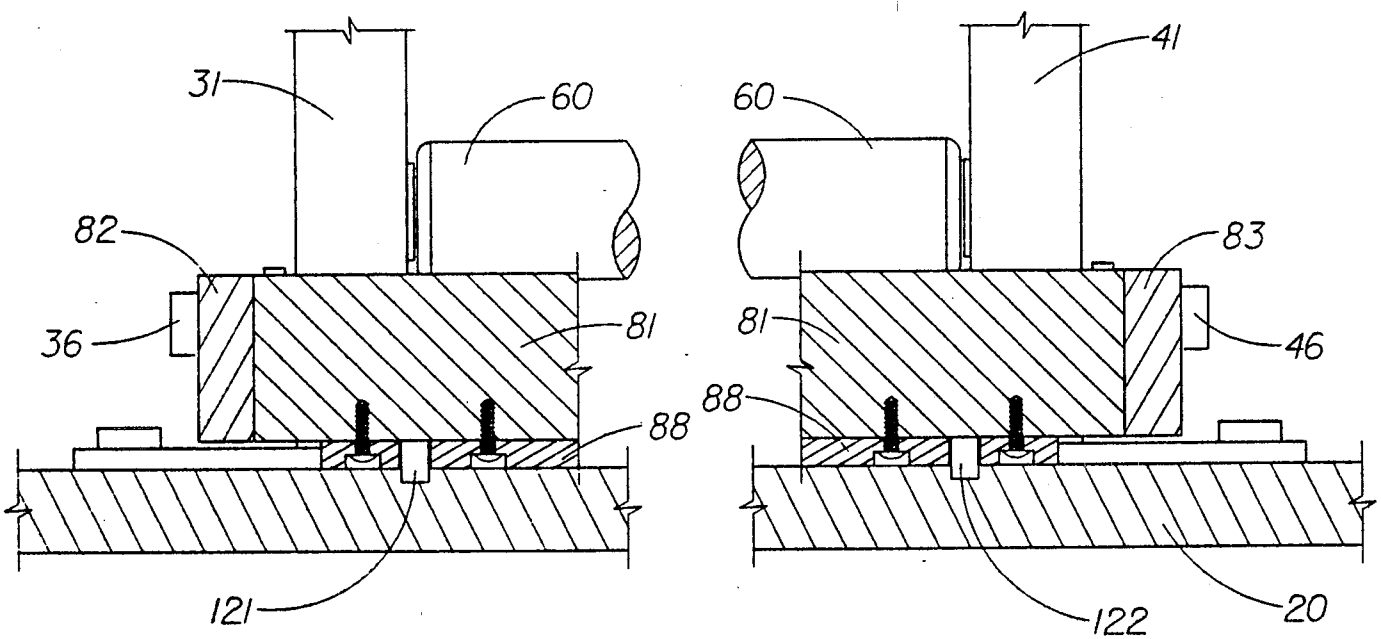
FIG. 10 is a section view of the FIG. 1 media handling and cutting device taken along line 10—10 on FIG. 2.
Figure 11:
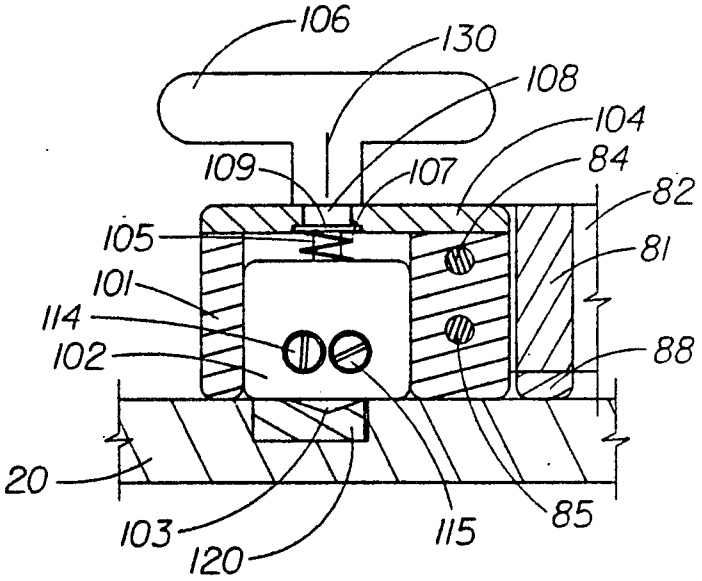
FIG. 11 is a section view of the FIG. 1 media handling and cutting device taken along line 11—11 on FIG. 2, illustrating the cutter head assembly and the working surface.

Bar 88 is a straight slender bar made of a suitable material such as, for example, plastic, having uniform cross sectional dimensions, a smooth surface finish, and radiused bottom edges (see FIG. 10 and FIG. 11). Bar 88 is equivalent in width to front member 81 and is greater in length than the distance between spacers 121 and 122. Bar 88 is attached to front member 81 using a suitable joining method such as, for example, countersunk screws, such that bar 88 is centered upon front member 81. Holes bored through bar 88 allow spacers 121 and 122 to extend through bar 88 and contact the bottom surface of front member 81. Spacers 121 and 122 are substantially cylindrical rods constructed of a suitable material such as, for example, plastic, with smooth outer surfaces to prevent snagging or excessive frictional resistance to the passage of media. The holes bored through bar 88 for spacers 121 and 122 are of suitable diameter to prevent interference with spacers 121 and 122 as u-shaped assembly 80 is pivoted to and from working surface 20. Spacers 121 and 122 are located upon working surface 20 substantially coincident with the longitudinal centerline of bar 88 when u-shaped assembly 80 is lowered against working surface 20, such that media may be directed between spacers 121 and 122 and substantially centered upon working surface 20 without excessive side to side movement upon working surface 20. Spacers 121 and 122 are secured to working surface 20 using a suitable joining technique such as, for example, a press fit between spacers 121 and 122 and holes drilled within working surface 20.

Rods 84 and 85 are cylindrical rods, appropriate in diameter to provide sufficient rigidity, which are attached to side members 82 and 8 by placing rods 84 and 85 within holes drilled through side members 82 and 83 (see FIG. 1, FIG. 2, FIG. 3, and FIG. 9). Rods 84 and 85 are sufficiently greater in length than the perpendicular distance between the outer surfaces of side members 82 and 83 such that push nuts 94, 95, 96, and 97, placed on the ends of rods 84 and 85, secure rods 84 and 85 upon side members 82 and 83. Rods 84 and 85 are secured upon side members 82 and 83 so as to be parallel to one-another and parallel to front member 81, and such that rods 84 and 85 position the bottom surface of cutter head assembly 100 flatly against working surface 20.

Lift pins 86 and 87 are rigidly secured to side members 82 and 83 using, for example, a press fit between holes drilled through side members 82 and 83 and the outer surfaces of lift pins 86 and 87. Lift pins 86 and 87 extend beyond the inner surfaces of side members 82 and 83 and slightly beyond the inner surfaces of linkage members 70 and 75 (see FIG. 1 and FIG. 6). Lift pins 86 and 87 are secured to side members 82 and 83 at locations such that lift pins 86 and 87 do not contact the bottom surfaces of linkage members 70 and 75 when u-shaped assembly 80 is fully lowered against working surface 20 and simultaneously contact and raise linkage members 70 and 75 as u-shaped assembly 80 is pivoted a sufficient distance away from working surface 20. Lift pins 86 and 87 are appropriate in diameter to provide sufficient rigidity and are constructed of a suitable material such as, for example, plastic, such that the bottom surfaces of linkage members 70 and 75 slide smoothly upon lift pins 86 and 87 as linkage members 70 and 75 are raised and lowered during pivoting of u-shaped assembly 80.

Cutter head assembly 100 is comprised of housing 101, cylinder 102, blade 103, cover 104, stud 105, handle 106, spring 107, square nut 108, washer 109, screws 110, 111, 112, 113, and blade screws 114 and 115 (see FIG. 1, FIG. 2, FIG. 11, and FIG. 12). Housing 101 is retained upon rods 84 and 85 such that the bottom surface of housing 101 is positioned flat upon working surface 20. Rods 84 and 85 pass through holes in housing 101, the holes in housing 101 being substantially parallel to the longitude axis of rods 84 and 85 and slightly greater in diameter than the diameter of rods 84 and 85, such that housing 101 may slide upon rods 84 and 85. Cylinder 102 is inserted within a hole bored through housing 101, the longitudinal centerline of the hole being substantially perpendicular to working surface 20 when the bottom surface of housing 101 is placed flat upon working surface 20, the hole being slightly larger in diameter than the diameter of cylinder 102 such that cylinder 102 may slide within the hole and the bottom surface of cylinder 102 may be positioned flatly upon working surface 20. Cylinder 102 being substantially cylindrical in shape, with substantially flat ends which are substantially perpendicular to the longitudinal centerline of cylinder 102. Cylinder 102 and housing 101 being constructed of suitable materials, such as, for example, plastic, such that cylinder 102 may slide within housing 101 and housing 101 may slide upon rods 84 and 85 without excessive frictional resistance.

One end of stud 105 is connected to cylinder 102 and the opposite end of stud 105 is connected to handle 106, both connections being made using a suitable joining technique such as, for example, a threaded connection between threaded ends of stud 105 and corresponding threaded holes in cylinder 102 and handle 106. The connection between cylinder 102 and stud 105 being made such that the longitudinal centerline of stud 105 is substantially coincident with the longitudinal centerline of cylinder 102. Upon stud 105, between cylinder 102 and handle 106, cover 104, square nut 108, washer 109, and spring 107 are retained. Square nut 108 being attached to stud 105 at a location immediately below the bottom surface of handle 106, the means for attachment being a suitable joining technique, such as, for example, threading square nut 108 onto stud 105 and welding it in place. Cover 104 is retained upon stud 105 such that square nut 108 may be inserted within a substantially square hole in cover 104, the hole being slightly larger in dimension that the dimension between the flats of square nut 108, such that square nut 108 may not be excessively rotated about its longitudinal axis when inserted with the corresponding hole in cover 104. Washer 109, located beneath square nut 108 and between cover 104 and cylinder 102, provides a surface upon which spring 107 may act upon such that spring 107, when compressed against washer 109, may transmit a force through washer 109 and upon cover 104. The diameter of the base of handle 106 is sufficiently larger than the dimensions of the substantially square hole in cover 104 such that cover 104 may not pass beyond the bottom of the base of handle 106. Cover 104 is removably secured to housing 101 using screws 110, 111, 112, and 113, such that cylinder 102 is positioned within housing 101 with the longitudinal centerline of cylinder 102 and the centerline of the substantially square hole in cover plate 104 being substantially coincident with the longitudinal centerline of the corresponding hole through housing 101. The substantially square hole in cover plate 104 being oriented with cover plate 104 such that, when cover plate 104 is secured to housing 101, two of the parallel sides of the substantially square hole in cover plate 104 are substantially parallel to the longitudinal centerlines of bars 84 and 85 when housing 101 is attached to bars 84 and 85.

The length and diameter of stud 105, the depth and diameter of spring seat 116, the length of cylinder 102, the corresponding dimensions of housing 101, and spring 107 are cooperatively arranged such that spring 107 is always in compression, prevented from yielding, and prevented from binding with stud 105 and spring seat 116 when cutter head assembly 100 is fully assembled and operated.

Blade 103 is a cutting blade with a sharpened v-shaped cutting edge. Blade 103 is substantially uniform in thickness and is constructed of a suitable cutting blade material such as, for example, hardened steel. Blade 103 is inserted within a slot in cylinder 102 and is secured in position using blade screws 114 and 115 such that blade 103 is positioned substantially parallel to the longitudinal centerline of cylinder 102 with the v-shaped cutting edge of blade 103 extending beyond the bottom surface of cylinder 102. The slot in cylinder 102 is slightly wider in dimension than the thickness of blade 103 such that blade 103 may be inserted and positioned within the slot without excessive play between blade 103 and the substantially parallel sides of the slot. The dimensions of blade 103, the extent to which the v-shaped edges of blade 103 protrude beyond the bottom surface of cylinder 102, and the radial distance from the longitudinal centerline of cylinder 102 at which blade 103 is positioned, are cooperatively arranged such that the length of the chord defined by an imaginary line between the points of intersection of the v-shaped sides of blade 103 with the bottom surface of cylinder 102 is substantially equivalent to the radial distance between the longitudinal centerline of cylinder 102 and the points of intersection of the v-shaped sides of blade 103 with the bottom surface of cylinder 102. The perpendicular distance between the bottom surface of cylinder 102 and the pointed tip of blade 103 is less than the longitudinal thickness of square nut 108 such that, when cutter head assembly 100 is completely assembled, the pointed tip of blade 103 is above the bottom surface of housing 101 when handle 106 is pulled upward and square nut 108 is moved out from the substantially square hole in cover 104 to the point where the bottom surface of square nut 108 is even with the top surface of cover 104.

The substantially square hole in cover 104 is oriented such that, when media handling and cutting device 10 is fully assembled, two of the parallel sides of the substantially square hole in cover 104 are substantially parallel to front member 81 and the other two parallel sides of the substantially square hole in cover 104 are substantially perpendicular to front member 81. The orientation of the substantially square hole in cover 104 enables blade 103 to be positioned either substantially perpendicular or parallel to front member 81 when square nut 108 is lowered within the substantially square hole in cover 104. Handle 106 is secured upon stud 105 with the top portion of handle 106 being substantially parallel to blade 103. Marking 130 indicates the location of blade 103 with respect to the handle. Markings 131, 132, 133, 134, 135, and 136 indicate the cutting locations, relative to working surface 20 and the media to be handled and cut, to which blade 103 may be rotated when square nut 108 is positioned within the substantially square hole in cover 104.

Ruler 140 is constructed of a suitable material such as, for example, thin plastic film, and is attached to front member 81 using a suitable joining means, such as, for example an adhesive. Ruler 140 may be used in cooperation with markings 133, 134, 135, and 136 to position blade 103 at a desired location for cutting the width of media 5 and to mark media 5 at measured locations as desired by the user (see FIG. 1, FIG. 2, and FIG. 3).

Ruler 141 and ruler 142 are constructed of a suitable material such as, for example, thin plastic film, and are attached to the top of working surface 20 using a suitable joining means, such as, for example, an adhesive (see FIG. 1, FIG. 2, and FIG. 7). Ruler 141 and ruler 142 may be used to measure and cut media 5 to length and to place markings upon media 5 at measured locations, as desired by the user. Ruler 141 and ruler 142 are located upon working surface 20 such that the ruled edges of ruler 141 and 142 are substantially aligned with the corresponding edges of media 5.

Figure 12:
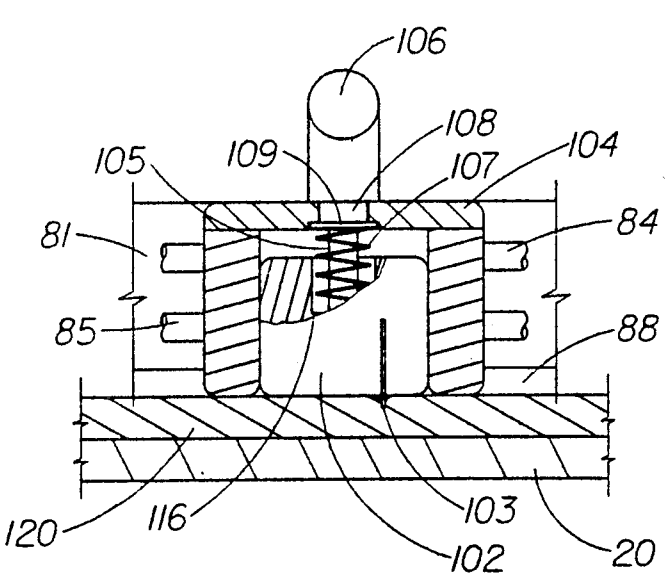
FIG. 12 is a section view of the FIG. 1 media handling and cutting device taken along line 12—12 on FIG. 3, illustrating the cutter head assembly and the working surface.

Elastomeric strip 120 is secured within a slot in working surface 20 using, for example, an adhesive, such that the top of elastomeric strip 120 is flush with the top of working surface 20, and the longitudinal centerline of elastomeric strip 120 is substantially parallel to the longitudinal centerline of front member 81 (see FIG. 7, FIG. 11, and FIG. 12). The width of the slot in working surface 20 is greater that the width of elastomeric strip 120 such that blade 103 extends below the top of working surface 20 between elastomeric strip 120 and the side of the slot when blade 103 is oriented parallel to front member 81 and u-shaped assembly 80 is lowered against working surface 20. The thickness and compressive stiffness of elastomeric strip 120 is such that, when blade 103 is oriented perpendicularly to front member 81 and u-shaped assembly 80 is lowered against working surface 20, blade 103 pierces media 5, placed between cutter head assembly 100 and working surface 20, and compresses elastomeric strip 120 without cutting elastomeric strip 120. Elastomeric strip 120 is constructed of a suitable material such as, for example, closed cell foam rubber.

During normal operation of media handling and cutting device 10, the user inserts hubs 50 and 55 in the ends of roll of media 5 and places the assembly of roll of media 5 and hubs 50 and 55 upon media support columns 30 and 40 such that media 5 may be unwound, directed about roller 60, and placed upon working surface 20 with the desired side up. The user then grasps and raises u-shaped assembly 80 in the upward direction. As u-shaped assembly 80 is raised, lift pins 86 and 87 contact linkage members 70 and 75, thereby raising pivotal roller 65. With the free hand, the user reaches beneath u-shaped assembly 80 and pivotal roller 65, grasps the end of media 5, and pulls media 5 outward across working surface 20 and between spacers 121 and 122 to a location just beyond front member 81. The user then lowers u-shaped assembly 80 to contact working surface 20. The user may cut media 5 to length by positioning blade 103 parallel to front member 81 and sliding cutter head assembly 100 upon rods 84 and 85 across the width of media 5. The user may cut media 5 to a desired width by sliding cutter head assembly 100 upon rods 84 and 85 to the position corresponding to the desired width, positioning blade 103 perpendicular to front member 81, and pulling media 5 outward across working surface 20. Roller 60 guides media 5 towards working surface 20, pivotal roller 65 acts as a tensioner-positioner, and bar 88 positions media 5 flatly upon working surface 20 as media 5 is pulled outward across working surface 20. The user positions blade 103 in the appropriate cutting position by pulling handle 106 upward until square nut 108 is out of cover 104, rotating handle 106 to the proper position, and relaxing the pull on handle 106 and guiding square nut 108 into cover 104. The user may position blade 103 in a no-cut position by rotating handle 106 and square nut 108 to a position between the length and width cut positions and allowing square nut 108 to rest on top of cover 104.

Figure 13:
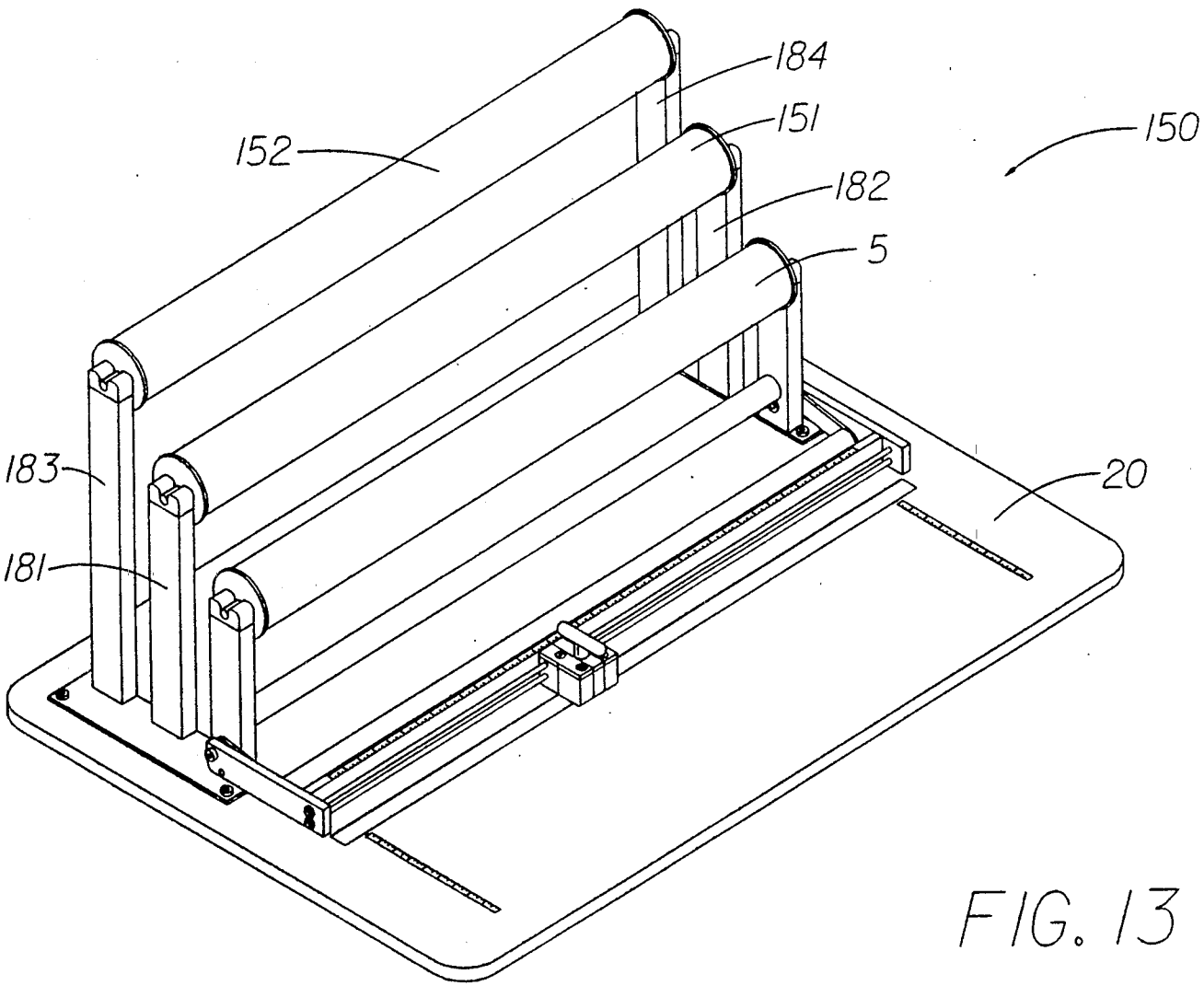
FIG. 13 is a perspective view of an alternate form of a media handling and cutting device according to a typical embodiment of the present invention.

Referring to FIG. 13, media handling and cutting device 150 illustrates an alternate form wherein roll of media 151 and roll of media 152 are positioned behind roll of media 5 upon media support columns 181, 182, 183, and 184, such that, at the users option, rolls of media 5, 151, and 152 may be individually or simultaneously unwound and positioned upon working surface 20 for subsequent operations.

What is claimed is:

1. A media handling and cutting device for handling and cutting rolled media, said rolled media which comprises media which has previously been wrapped about a media retaining device such as a cylinder, said media including paper, plastic film, and cloth, said media and handling device comprises:

(A) a working surface, said working surface lying in a substantially horizontal plane, said working surface including a rectangular shaped wooden table with a smooth, flat surface;

(B) means of supporting and positioning said rolled media with respect to said working surface, such that said media may be unwound from said media retaining device and positioned upon said working surface;

(C) said means of supporting and positioning said rolled media with respect to said working surface comprises a media support column and adapter cooperatively arranged at each longitudinal end of said media retaining device, such that the effective longitudinal axis of said rolled media is positioned substantially parallel, in a horizontal plane, to said working surface;

(D) said adapters, including hubs with substantially concentric hub shafts, said hub shafts extending through said hubs and beyond for connection to said media support column, said hubs for attaching adapter to said media retaining device;

(E) said media support columns, each including a rigid member having a mounting base at one end and a bearing surface at the opposite end, said mounting base for attaching said media support column to said working surface, said bearing surface to contact said hub shaft;

(F) auxiliary means for disposing said media upon said working surface including:

(a) a substantially cylindrical roller cooperatively arranged with said media support columns such that the longitudinal axis of said cylindrical roller is substantially parallel, both in vertical and horizontal planes, to the effective longitudinal axis of said rolled media, the means of attaching said cylindrical roller including shafting passing through the longitudinal axis of said cylindrical roller and beyond into said media support columns at a location below said rolled media and above said working surface, such that media drawn from said media retaining device, about said cylindrical roller and towards said working surface is substantially aligned to said working surface;

(b) a pivotal roller assembly which comprises a substantially cylindrical roller, two linkage members, means of attaching said linkage members to said cylindrical roller and means of attaching said linkage members to said media support columns, said linkage members being of substantially equal length, one end of each said linkage member attaching to opposite longitudinal ends of said cylindrical roller and the opposite end of each said linkage member attaching to said media support columns, said attachment means comprising shafting passing through one end of each said linkage member and beyond into said cylindrical roller along the longitudinal center-line of said cylindrical roller, and shafting passing through the opposite end of each said linkage member and beyond into said media support columns, such that said cylindrical roller freely rotates and said pivotal roller assembly pivots about an axis substantially parallel to the effective longitudinal axis of said rolled media, such that said pivotal roller assembly may be raised to allow media to be positioned upon said working surface below said cylindrical roller and lowered to position said media flatly against said working surface;

(c) a pivotal u-shaped assembly which comprises a u-shaped member and a means for attaching said u-shaped member to said media support columns, said u-shaped member oriented such that the parallel sides of said u-shaped member project rearward to said media support columns and the base side of said u-shaped member is substantially parallel to the effective longitudinal axis of said rolled media and to said working surface, said means of attaching said u-shaped member to said media support columns include shafting passing through the parallel sides of said u-shaped member at the open end of said u-shaped member, and beyond into said media support columns such that said u-shaped member may be raised for said media to be placed between said u-shaped member and said working surface and lowered to position said media substantially flat against said working surface;

(d) means for guiding and positioning said media upon said working surface, including ruled markings and spacers, said ruled markings placed upon said u-shaped member such that the width of said media placed upon said working surface may be measured and said ruled markings placed upon said working surface such that the length of said media placed upon said working surface may be measured, said spacers attached to said working surface and extending upward above the top of said working surface, said spacers being located upon said working surface such that the edges of said media are positioned upon said working surface substantially parallel to a vertical plane passing perpendicularly through the theoretical centerline of said rolled media, said spacers being positioned to provide sufficient clearance for the passage of said media between said spacers and to prevent substantial side to side movement of said media upon said working surface;

(G) a means of cutting the length and width of said media which comprises a cutting head and means for guiding said cutting head across the width of said media, cooperatively arranged to each other and to said u-shaped member such that said media may be cut to length as said cutting head is moved across the width of said media and said media may be cut to width as said media is pulled across said working surface beneath said u-shaped member and said cutting head, said cutting head comprising a housing, a cutting blade secured to a rotatable blade member, and means for securing said rotatable blade member to said housing such that said rotatable blade member may be selectively oriented by operator manipulation to cut said media to width and reoriented to cut said media to length, said cutting blade including a v-shaped blade sharpened along the v-shaped edge, said means of securing said rotatable blade member to said housing includes a square nut secured to and strategically located upon said rotatable blade member and a square opening formed within said housing such that insertion of said square nut within said square opening thereby prevents rotational movement of said rotatable blade member within said housing, said means of securing said rotatable blade member further includes a spring member strategically located such that said spring member exerts a force thereby retaining said square nut within said square opening until said square nut is withdrawn from said square opening by operator manipulation;

(H) said means for guiding said cutting head across the width of said media comprises shaft members attached to said u-shaped member substantially parallel to the effective longitudinal axis of said rolled media and substantially parallel to said working surface, said cutting head being retained upon said shaft members.

2. A media cutting device as described in claim 1, wherein a series of said rolled media are supported and positioned with respect to said working surface by a cooperative arrangement of said adapters and said bearing surfaces such that said media may be selected, individually or in combination, for placement upon said working surface.

* * * * *